US007261485B2

(12) United States Patent
Tsaur

(10) Patent No.: US 7,261,485 B2
(45) Date of Patent: Aug. 28, 2007

(54) INTEGRATED DELIVERY DEVICE

(76) Inventor: Garry Tsaur, 19222 Tranbarger St., Rowland Heights, CA (US) 91748

( * ) Notice: Subject to any disclaimer, the term of this patent is extended or adjusted under 35 U.S.C. 154(b) by 79 days.

(21) Appl. No.: 10/632,773

(22) Filed: Aug. 1, 2003

(65) Prior Publication Data

US 2005/0061829 A1 Mar. 24, 2005

(51) Int. Cl.
*B43K 1/06* (2006.01)

(52) U.S. Cl. ..... 401/265; 401/170; 401/171; 401/176

(58) Field of Classification Search ..... 401/170, 401/171, 176, 144, 145, 265, 126, 130, 173, 401/174, 6; 222/386, 389, 394, 391, 379, 222/381, 253

See application file for complete search history.

(56) References Cited

U.S. PATENT DOCUMENTS 2,809,386 A * 10/1957 Asturias, Jr. ..... 401/170
3,256,894 A * 6/1966 Gilbert ..... 401/176
3,316,923 A * 5/1967 Wagner ..... 401/190
3,738,761 A * 6/1973 Segerstad ..... 401/173

* cited by examiner

*Primary Examiner*—Khoa D. Huynh
(74) *Attorney, Agent, or Firm*—Joe Nieh

(57) ABSTRACT

An integrated delivery device that is both a container and an applicator for small quantity of fluids is disclosed. The integrated delivery device is particularly suitable for viscous substances. The integrated delivery device comprises of two slidably engaged sections with matching concave and convex surfaces wherein a small quantity of viscous fluid is enclosed between the two sections. When the two sections are urged toward each other, the small quantity of viscous fluid between the two sections is urged to exit through a channel in one of the two sections. The two sections will mate to form an integrated applicator that can be used to apply the extracted viscous fluid.

6 Claims, 4 Drawing Sheets

INTEGRATED DELIVERY DEVICE

BACKGROUND

1. Field of the Invention

The present invention relates generally to a device for containing and delivering a fluid. More specifically the present invention is an integrated device that is both a container and an applicator for a small quantity of viscous fluid.

2. Description of Related Art

Containers and applicators for small quantity of viscous fluids are virtually non-existent, particularly for minute quantity of viscous fluid. Single dose applications and samples generally only require a small quantity of viscous fluid to be dispenses and applied. However, due to lack of economical and efficient small container and applicators, most containers and applicators for small quantity of viscous fluid are much larger than necessary to contain and apply the small quantity of the viscous fluid required. Typically, the remaining viscous fluid must be discarded or the content will risk contamination due to repeated exposures to the applicator or the user.

Therefore, an economical and efficient container and applicator is desired that will enclose a small to minute quantity of a viscous fluid and extract virtually all of the viscous fluid from the container for application.

SUMMARY OF THE INVENTION

The present invention is an integrated delivery device that is both a container and an applicator for small quantity of fluids. The integrated delivery device is particularly suitable for viscous fluids. The integrated delivery device comprises of two slidably engaged sections with matching concave and convex surfaces wherein a small quantity of viscous fluid is enclosed between the two sections. When the two sections are urged toward each other, the small quantity of viscous fluid between the two sections is urged to exit through a channel in one of the two sections. The two sections will mate to form an integrated applicator that can be used to apply the extracted viscous fluid.

DETAILED DESCRIPTION OF THE PREFERRED EMBODIMENT

Figure 1:
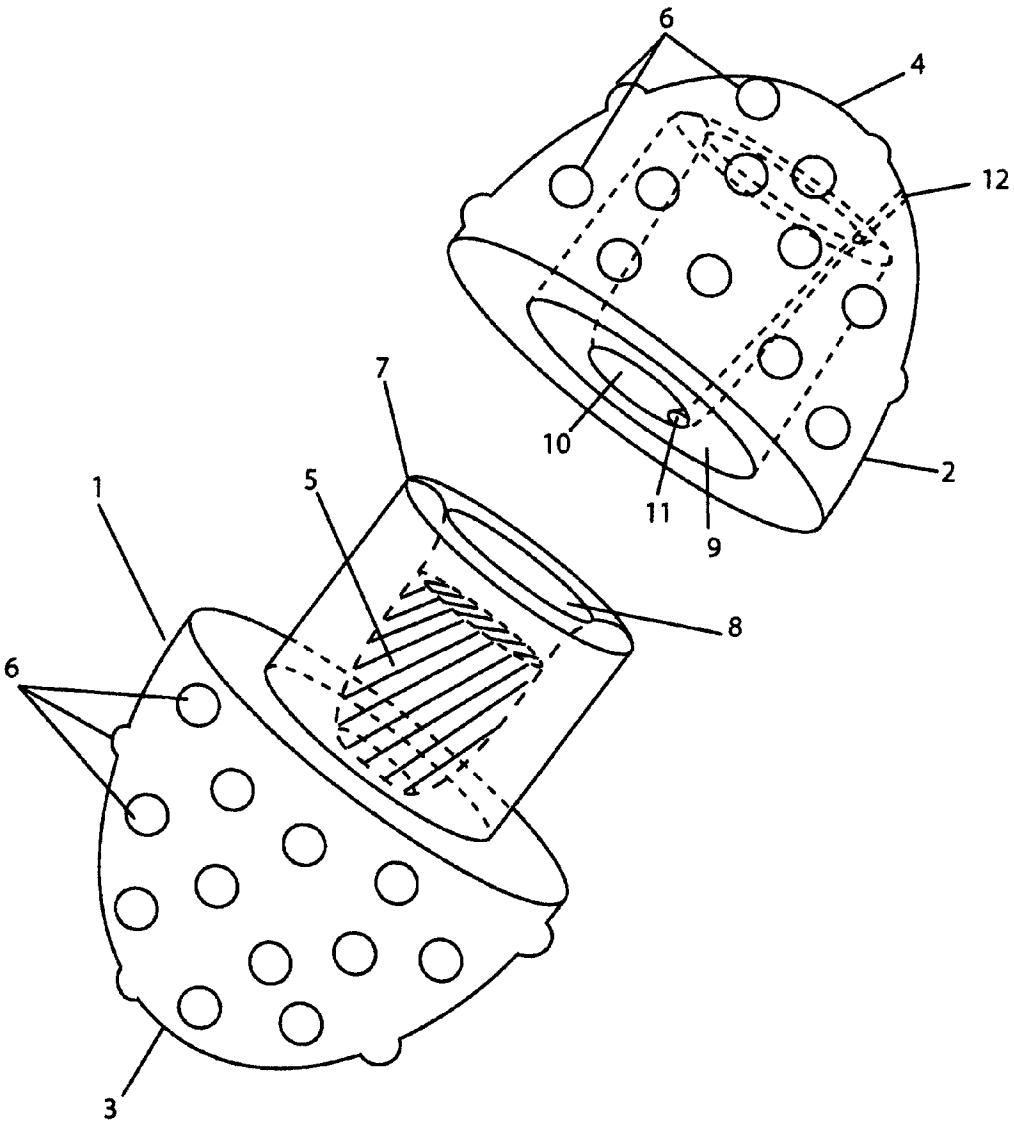
FIG. 1 shows a perspective view of the preferred embodiment of the integrated delivery device.

FIG. 1 shows a perspective view of the preferred embodiment of the integrated delivery device. In the preferred embodiment, the integrated delivery device comprises of two small slidably engaged sections 1, 2 each with a rounded end 3, 4 and with a matching concave or convex surfaces wherein a small quantity of viscous fluid 5 such as a cream or lip coloring is enclosed between the two sections 1, 2. The surfaces on the rounded ends 3, 4 may have multiple rounded protrusions 6 to assist in grasping the integrated delivery device and also in spreading and massaging the user's hands during application of the cream.

One section 1 has a cylindrical protrusion 7 that has a rounded end wherein the hole 8 defined by the cylindrical protrusion 7 is open at the rounded end and terminates at the other end in a closed and rounded terminal. The other section 2 has a recess 9 that closely matches the cylindrical protrusion 7 of the first section 1 with a matching protrusion 10 that engages the hole 8 defined by the cylindrical protrusion 7 in the first section 1. The matching protrusion 10 of the second section 2 has a small channel 11 formed through its length that will direct the viscous fluid 5 from the first section 1 into and out of the second section 2.

When the two sections 1, 2 are urged toward each other, the small quantity of viscous fluid 5 between the two sections 1, 2 is urged from the first section 1 into the second section 2 through the small channel 11 and exit through a hole 12 in the second section 2. The hole 12 may be covered by a removable film that may be made of paper, plastic, aluminum, or any other suitable material. The two sections 1, 2 will mate to form an integrated applicator that can be used to apply the extracted viscous fluid 5.

Figure 2B:
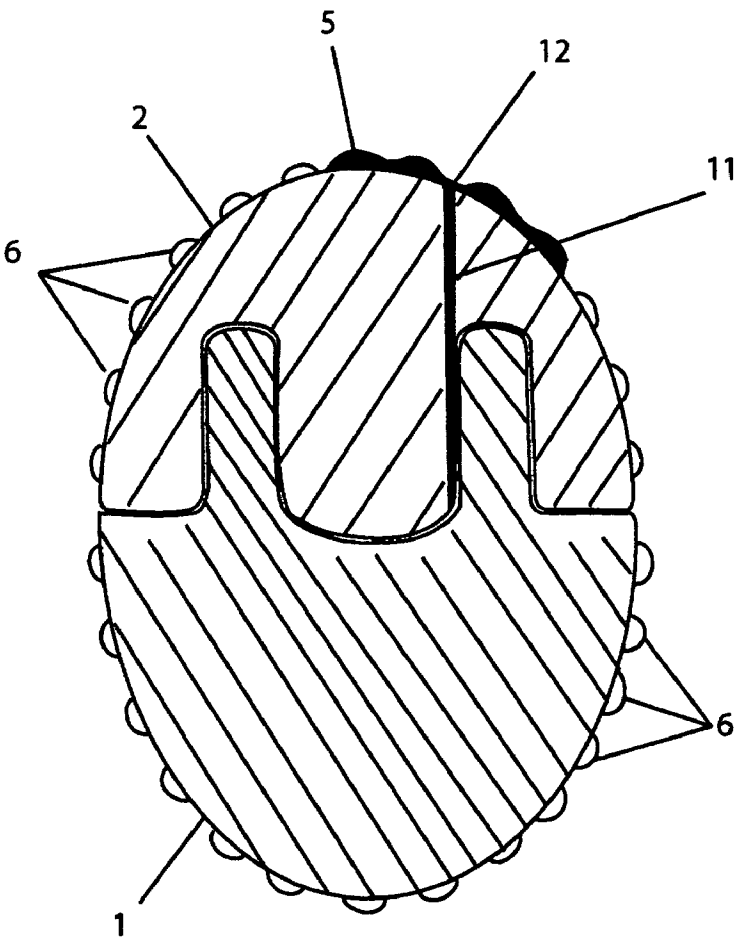
FIG. 2B shows the cross-sectional view of the preferred embodiment of the integrated delivery device at the delivery position.
Figure 2A:
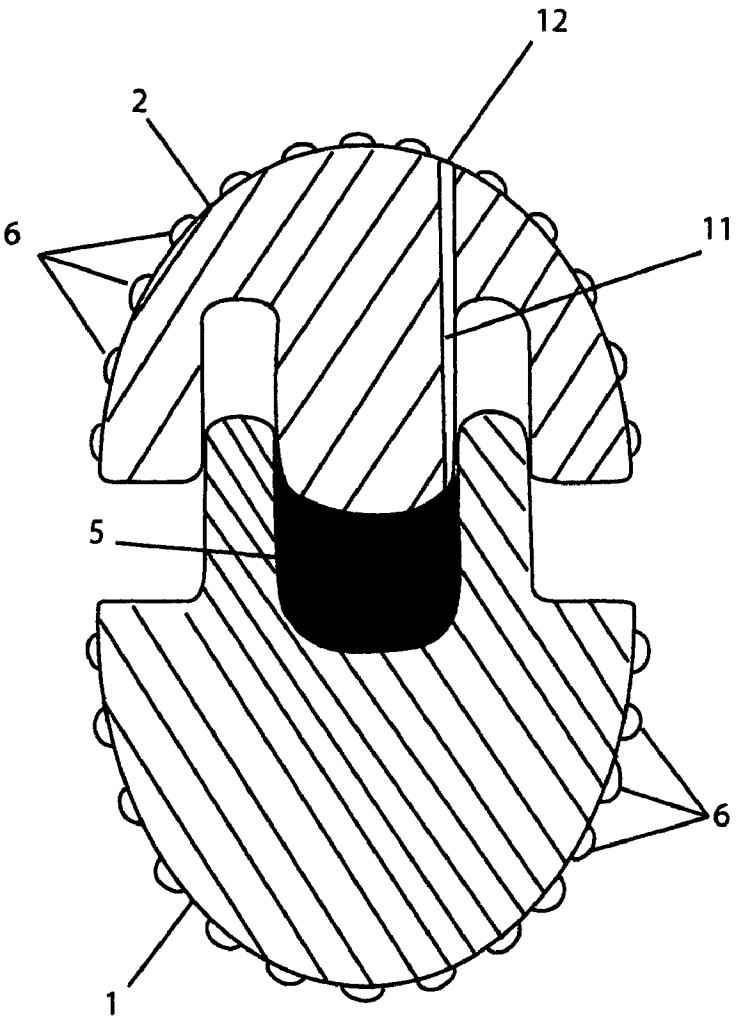
FIG. 2A shows the cross-sectional view of the preferred embodiment of the integrated delivery device at the initial position.

FIG. 2A shows the cross-sectional view of the preferred embodiment of the integrated delivery device at the initial position wherein the viscous fluid 5 is stored in the integrated delivery device. FIG. 2B shows the cross-sectional view of the preferred embodiment of the integrated delivery device at the delivery position wherein the two sections 1, 2 of the integrated delivery device are urged toward each other and the viscous fluid 5 in the integrated delivery device is extracted through the channel 11 in the second section 2 and out through a hole 12 in the second section 2. In this position, the integrated delivery device is in a compact form with the viscous fluid 5 extracted at the second section's 2 terminal.

Figure 3:
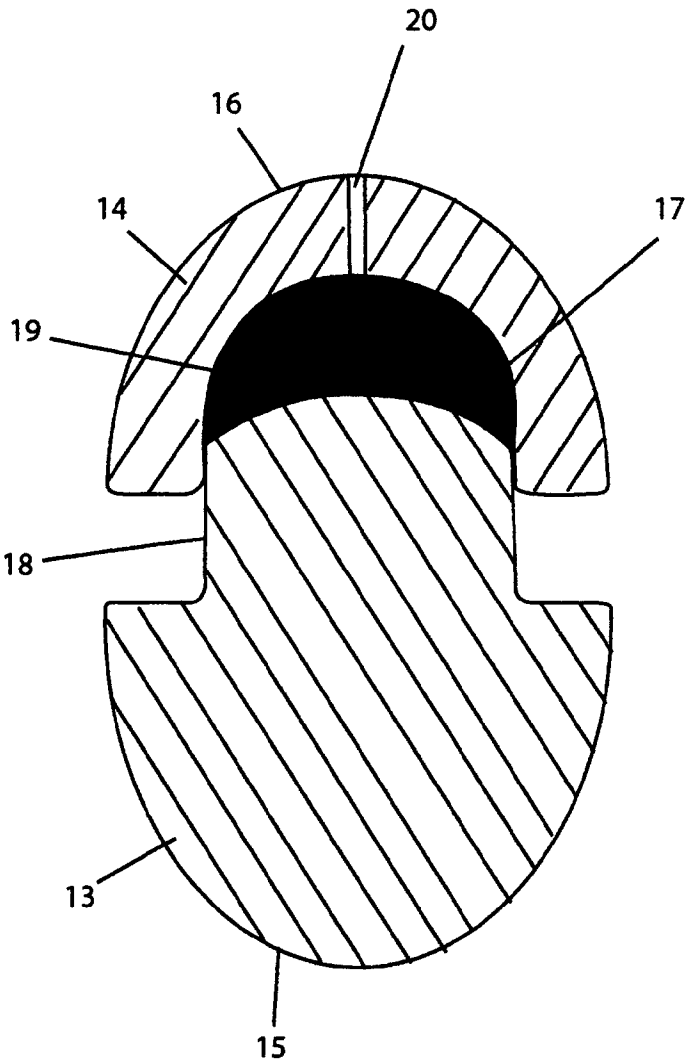
FIG. 3 shows another embodiment of the integrated delivery device.

FIG. 3 shows the cross-sectional view of another embodiment of the integrated delivery device. In this embodiment, the integrated delivery device comprises of two small slidably engaged sections 13, 14 each with a rounded end 15, 16 and with a matching concave or convex surface wherein a small quantity of viscous fluid 17 such as a cream or lip coloring is enclosed between the two sections 13, 14. The surfaces on the rounded ends 15, 16 may have multiple rounded protrusions to assist in grasping the integrated delivery device and also in spreading and massaging the user's hands during application of the cream.

One section 13 has a solid cylindrical protrusion 18. The other section 14 has a recess 19 that closely matches the solid cylindrical protrusion 18 of the first section 13. When the two sections 13, 14 are urged toward each other, the small quantity of viscous fluid 17 between the two sections 13, 14 is extracted from the integrated delivery device through a hole 20 in the second section 14. The two sections 13, 14 will mate to form an integrated applicator that can be used to apply the extracted viscous fluid 17.

Figure 4:
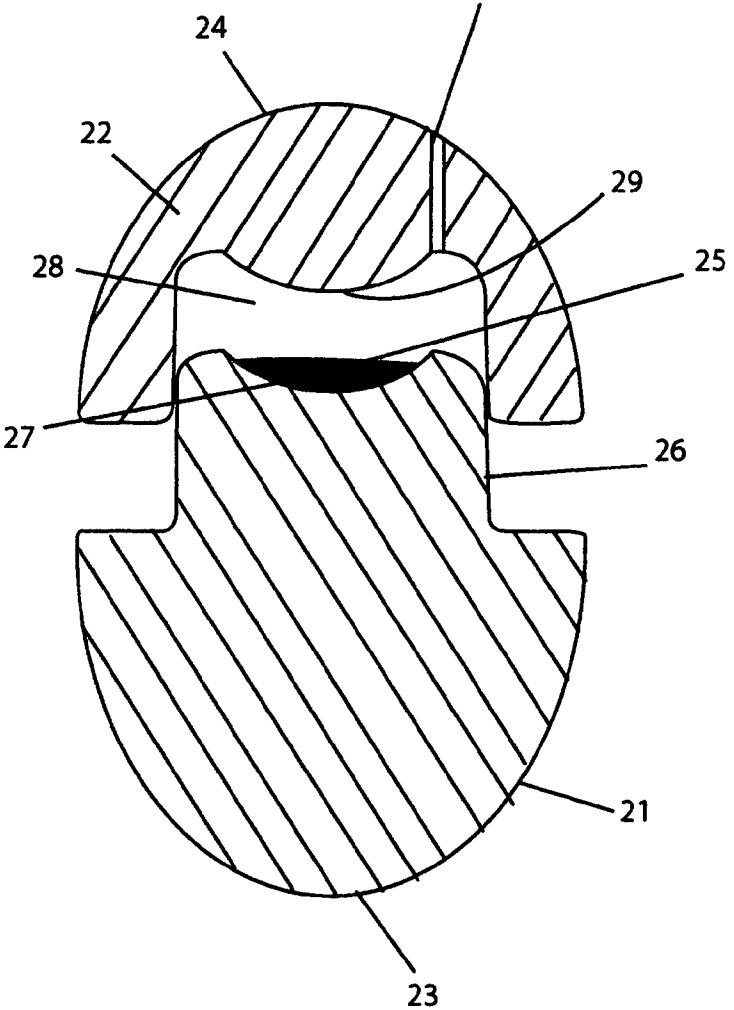
FIG. 4 shows another embodiment of the integrated delivery device.

FIG. 4 shows a cross-sectional view of another embodiment of the integrated delivery device. This embodiment of the integrated delivery device comprises of two small slidably engaged sections 21, 22 each with a rounded end 23, 24 and with a matching concave or convex surface wherein a minute quantity of viscous fluid 25 such as a cream or lip coloring is enclosed between the two sections 21, 22. The surfaces on the rounded ends 23, 24 may have multiple rounded protrusions to assist in grasping the integrated delivery device and also in spreading and massaging the user's hands during application of the cream.

One section 21 has a solid cylindrical protrusion 26 with a concave end 27 that will retain a viscous fluid 25 at the concave end 27. The other section 22 has a recess 28 that closely matches the solid cylindrical protrusion 26 of the first section 21 with a convex surface 29 that closely matches the concave end 27 of the solid cylindrical protrusion 26 in the first section 21. When the two sections 21, 22 are urged toward each other, the minute quantity of viscous fluid 25 between the two sections 21, 22 is extracted from the integrated delivery device through a hole 30 in the second section 22. The two sections 21, 22 will mate to form an integrated applicator that can be used to apply the extracted viscous fluid 25.

Figure 5:
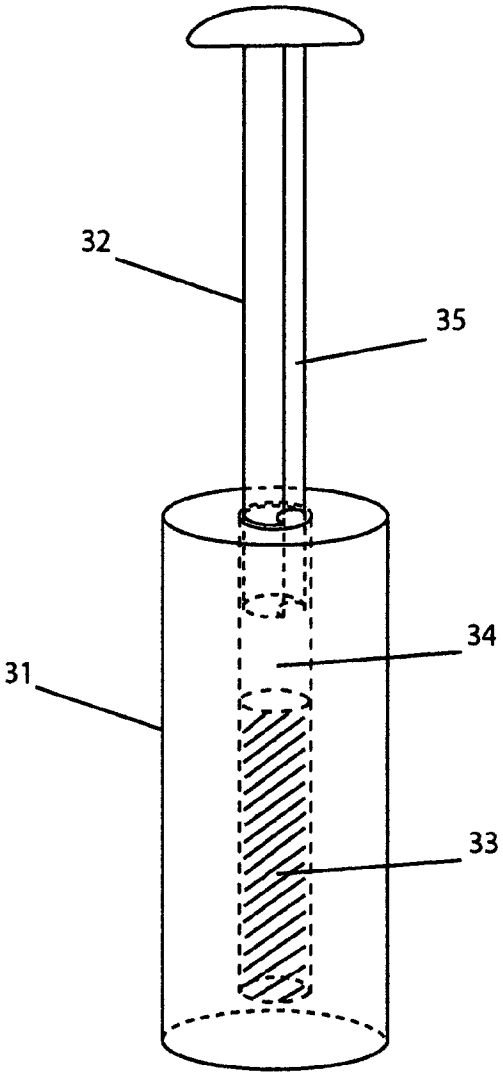
FIG. 5 shows another embodiment of the integrated delivery device.

FIG. 5 shows another embodiment of the integrated delivery device. In this embodiment, the integrated delivery device comprises of two small slidably engaged sections 31, 32 generally in the shape of elongated cylinders wherein a small quantity of viscous fluid 33 such as a cream or lip coloring is enclosed between the two sections 31, 32.

The first section 31 has a cylindrical recess 34 retaining the viscous fluid 33. The second section 32 is approximately the same dimension as the cylindrical recess 34 in the first section 31. The second section 32 has a small channel 35 formed through its length that will extract the viscous fluid 33 from the first section 31 out through the small channel 35.

When the two sections 31, 32 are urged toward each other, the small quantity of viscous fluid 33 between the two sections 31, 32 is urged from the first section 31 to exit through the small channel 35. The two sections 31, 32 will mate to form an integrated applicator that can be used to apply the extracted viscous fluid 33.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. An integrated delivery device comprising:

a first section comprising a rounded end and a cylindrical protrusion in an opposite end wherein a small quantity of viscous fluid is disposed within said cylindrical protrusion; and a second section comprising a rounded end and a recess that approximates the cylindrical protrusion of the first section with a matching protrusion that engages a hole at the center of the cylindrical protrusion of the first section wherein the matching protrusion has a small channel through its length that will direct the viscous fluid from the first section into and out of the second section;

wherein when the first section and the second section are urged toward each other, the recess in the second section encloses the cylindrical protrusion of the first section and the matching protrusion in the second section inserts into the hole at the center of the cylindrical protrusion of the first section thereby extracting the viscous fluid will be extracted from the integrated delivery device for application.

2. An integrated delivery device as in claim 1, wherein a removable film covers said small channel.

3. An integrated delivery device as in claim 1, wherein said rounded ends of said first section and said second section have multiple rounded protrusions to assist in the grasping of the integrated delivery device and also in application of the viscous fluid.

4. An integrated delivery device as in claim 3, wherein said viscous fluid is a cream.

5. An integrated delivery device as in claim 1, wherein said viscous fluid is a cream.

6. An integrated delivery device as in claim 1, wherein said rounded end of said second section is generally in the form of a tip of a lipstick.

* * * * *